United States Patent [19]

Oya

[11] 3,981,217

[45] Sept. 21, 1976

[54] KEY ASSIGNER

[75] Inventor: Akiyoshi Oya, Hamamatsu, Japan

[73] Assignee: Nippon Gakki Seizo Kabushiki Kaisha, Japan

[22] Filed: Sept. 2, 1975

[21] Appl. No.: 609,846

[30] Foreign Application Priority Data

Sept. 5, 1974 Japan ..... 49-102365
Sept. 6, 1974 Japan ..... 49-102640

[52] U.S. Cl. ..... 84/1.03; 84/1.01
[51] Int. Cl.[2] ..... G10F 1/00
[58] Field of Search ..... 84/1.01, 1.03, 1.11, 84/1.24, 1.26

[56] References Cited

UNITED STATES PATENTS

| | | | |
|---|---|---|---|
| 3,610,799 | 10/1971 | Watson | 84/1.26 |
| 3,697,661 | 10/1972 | Deutsch | 84/1.01 |
| 3,746,773 | 7/1973 | Uetrecht | 84/1.03 |
| 3,760,358 | 9/1973 | Isii | 84/1.01 |
| 3,828,643 | 8/1974 | Morez | 84/1.01 |
| 3,842,184 | 10/1974 | Knierkamp | 84/1.01 |
| 3,899,951 | 8/1975 | Griffith et al. | 84/1.03 |

*Primary Examiner*—L. T. Hix
*Assistant Examiner*—Vit W. Miska
*Attorney, Agent, or Firm*—Ladas, Parry, Von Gehr, Goldsmith & Deschamps

[57] ABSTRACT

A key assigner for use in an electronic musical instrument is capable of detecting changes in key switches by comparing present ON-OFF states of the key switches with previous ON-OFF states thereof. Only one of detection signals is delivered out by a priority circuit in a predetermined order of priority and a key code corresponding to this delivered out signal is produced. This key code is compared with key codes of respective channels previously stored in a key code memory having channels equal in number to an available tone number (i.e. a maximum number of tones to be reproduced simultaneously) to detect whether there is coincidence or not. A detection signal produced in a case where there is coincidence represents release of the key, whereas a detection signal produced in a case where there is no coincidence represents new depression of the key, and in this latter case the key code is stored in the key code memory. The outputs of the key code memory are decoded to provide tone generation control signals. An example is shown in which the priority circuit is applied to a monophonic music synthesizer.

5 Claims, 8 Drawing Figures

KEY ASSIGNER

BACKGROUND OF THE INVENTION

This invention relates to a key assigner for use in an electronic musical instrument.

A prior art key assigner employed in an electronic musical instrument capable of producing a plurality of tones simultaneously is constructed in such a manner that key switches are scanned sequentially and repetitively by a high rate clock to produce ON-OFF information of the key switches which information is a key data signal representing depressed keys by existence of pulses at allotted time slots of time shared multiplexing and that such key data are respectively assigned to time shared channel in digital code fashion, the number of the channels being equal to a maximum number of tones to be available simultaneously. According to this prior art key assigner, detection of the ON-OFF states of the respective keys is conducted in a predetermined order with a result that an undesirable time lag occurs between the actual ON-OFF operations of the key switches and the detection of the same. The prior art key assigner requires a complicated keyboard circuit for scanning the key switches in a predetermined order. Further, the key assigner needs a relatively high rate of clock pulse for the high rate scanning. This naturally requires a high manufacturing cost.

SUMMARY OF THE INVENTION

It is therefore an object of the present invention to provide a key assigner capable of detecting changes in key switches in parallel without scanning them but by comparing present ON-OFF states of these key switches with previous ON-OFF states thereof and thereby producing key information representing change in the states of the keys.

It is another object of the invention to provide a key assigner capable of using a low rate clock and a simplified keyboard circuit with a resultant reduction of the cost of manufacture.

It is another object of the invention to provide a key assigner comprising a digital type priority circuit which selects in a predetermined priority order a single signal from among a plurality of digital input signals representing depression and release of keys by logical values of "1" and "0" and delivers out this single signal and thereby being capable of obtaining a signal used for controlling reproduction of tones in a monophonic music synthesizer.

These and other objects and features of the invention will become apparent from the description made hereinbelow with reference to the accompanying drawings.

DESCRIPTION OF A PREFERRED EMBODIMENT

Figure 1:
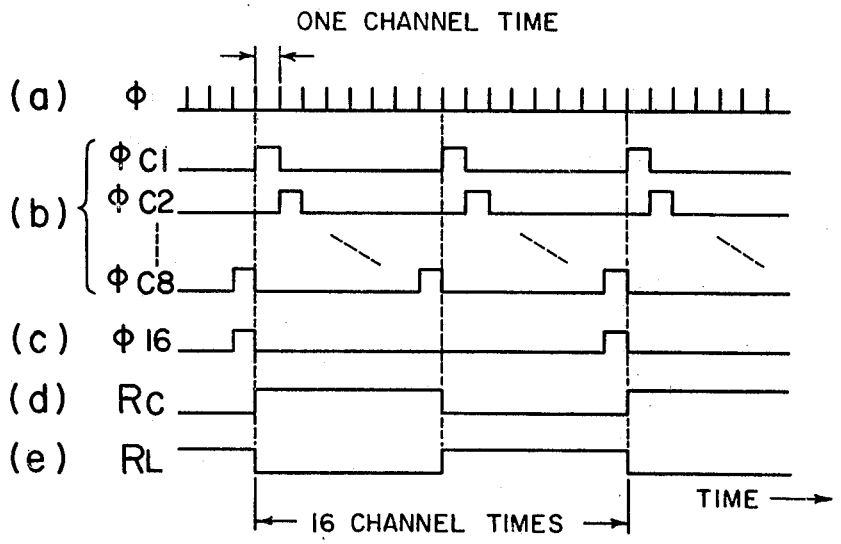
FIGS. 1 (*a*) through 1 (*e*) are timing charts showing relations between various clock pulses used in the key assigner according to the invention.

Let us first assume that an available tone number (i.e. a maximum number of tones to be reproduced simultaneously) is eight in the present embodiment. Various clock pulses are used in the key assigner according to the invention and relationship between these clocks is very important. Description will therefore be made about relationship between these clocks. FIG. 1 (*a*) shows a master clock $\phi$. A relatively low rate of clock whose period is, for example, in the order of one ms (e.g. 1 ms), can be used as the master clock $\phi$. Pulse interval of the master clock $\phi$ is hereinafter called "channel period". FIG. 1 (*b*) shows a first channel synchronizing clock $\phi c_1$ through an eighth channel synchronizing clock $\phi_{c8}$. These synchronizing clocks are obtained by sequentially counting the master clock $\phi$ in an octanary counter and decoding the results of counting. FIG. 1 (*c*) shows a system synchronizing clock $\phi_{c16}$. This clock $\phi_{c16}$ is produced in synchronization with every other pulse of the eight channel synchronizing clock $\phi_{c8}$ and has a period equivalent to 16 channel periods (e.g. 16 ms). FIG. 1 (*d*) shows a comparison region pulse Rc and FIG. 1 (*e*) a load region pulse RL respectively. These pulses Rc and RL have a pulse width of 8 channel periods and a pulse period of 16 channel periods and one of them is an inverted signal of the other. The comparison region pulse Rc rises at the start of a channel period immediately following the system synchronizing clock $\phi_{16}$. And after eight channel times, the comparison region pulse Rc falls and the load region pulse RL rises. And the system synchronizing clock $\phi_{16}$ is produced in the last channel period of the load region pulse RL.

Figure 2:
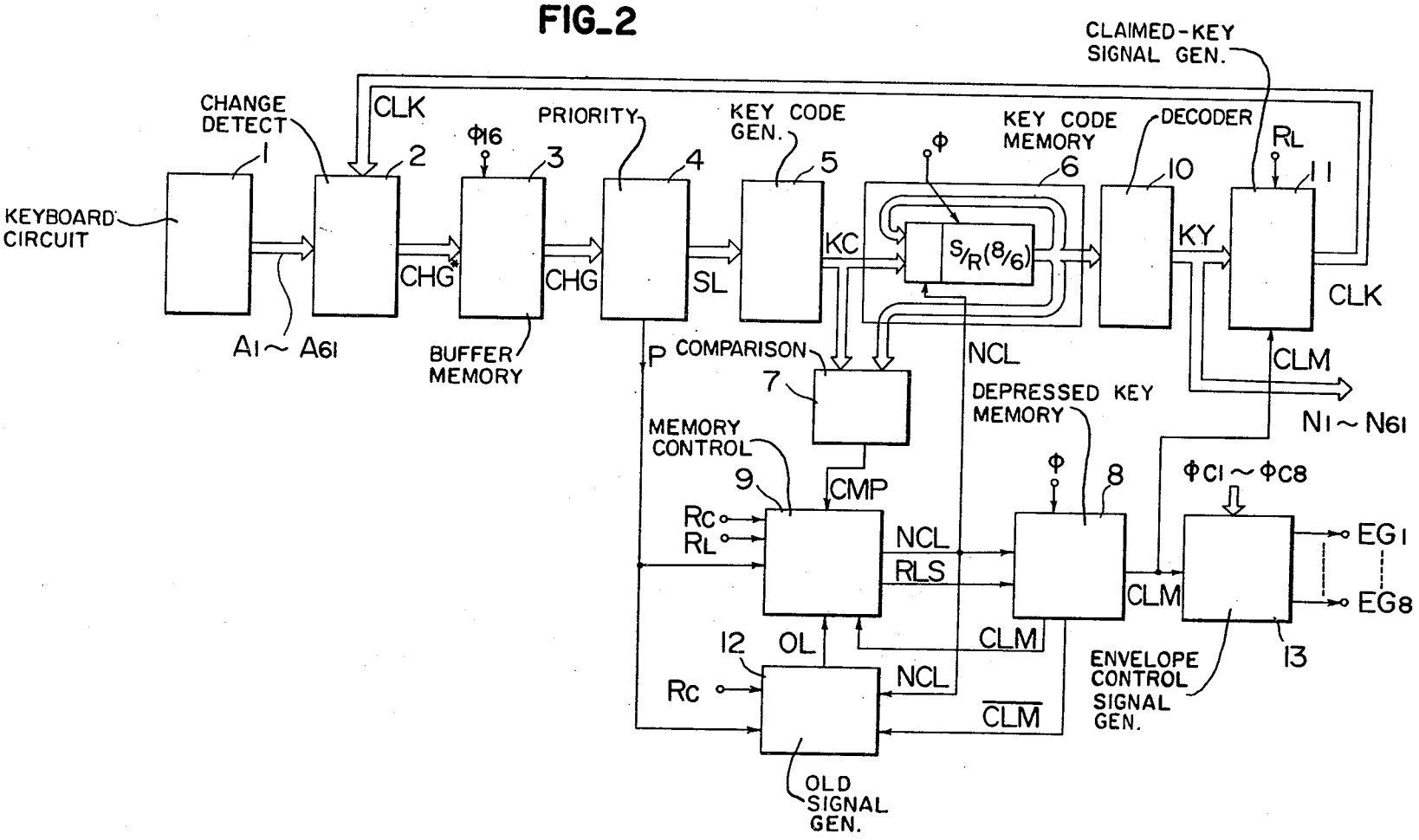
FIG. 2 is a block diagram showing a preferred embodiment of the key assigner according to the invention.

FIG. 2 is a block diagram showing an example of the key assigner embodying the invention. A keyboard circuit 1 produces from its plurality of parallel output lines detection signals indicating ON-OFF states of respective key switches driven by keys of the keyboard. If there are 61 keys in all, a signal for each of the 61 keys is provided on a corresponding one of 61 output lines $A_1 - A_{61}$. In the present embodiment, an OFF state of a switch is represented by a signal "1" and an ON state thereof by a signal "0" respectively.

A change detection circuit 2 is provided for comparing by each key switch the ON-OFF detection signals for the respective keys provided from the keyboard circuit 1 with claimed key signals CLK which represent whether or not information as to whether tones corresponding to the respective keys are being produced has already been stored and, upon detection of change in the states of the key switches, producing change signals CHG* for the respective key switches. If the ON-OFF detection signal coincides with the claimed key signal CLK, this state signifies that there is no change, and if these signals do not coincides with each other, this state signifies that there has been a change, i.e., a new key has been depressed or a depressed key has been released. Signals provided on 61 output lines of the change dtection circuit 2 are stored in a buffer memory 3 at a timing of the system synchronizing clock $\phi_{16}$ and kept memorized therein until the next timing of the clock $\phi_{16}$. The change signal CHG is "1" when there has been a change in the state of the key switch and "0" when there has been no change.

The output change signals CHG of the buffer memory 3 are applied to a priority circuit 4. The priority circuit 4 selects a single key switch among key switches in which change has occurred in accordance with a predetermined priority order (e.g. in the order of notes from the highest one to the lowest one) and provides a select signal SL on one of 61 output lines thereof corresponding to the selected single key. Further more, the priority circuit 4 produces a change occurence pulse P if there is a change signal CHG (signal "1") for any one of the key switches.

A key code generator 5 consists of an encoder capable of receiving outputs of the priority circuit 4 supplied on the 61 output lines of the priority circuit 4 and producing 6-bit binary key codes corresponding to the 61 different inputs. The keycode generator 5 produces a key code KC having contents representing a single output line of the priority circuit 4 on which the select signal SL has been delivered. The key code KC identifies the key switch which has undergone change and has been selected by the priority circuit 4. The contents of this key code KC do not change during 16 channel periods until the next system synchronizing clock $\phi_{16}$ comes. Detection is made within the 16 channel periods as to whether the key switch which has undergone change and has been selected by the priority circuit 4 is for a newly depressed key or a newly released key. If the detection concerns a newly depressed key, the key code KC is stored in a key code memory 6 and the above described claimed key signal CLK is set, whereas if the detection concerns a newly released key, the claimed key switch signal CLK is reset. The priority circuit 4 is provided for enabling such control operation to be effected sequentially by each signal key switch the state of which has changed.

The key code memory 6 consists of a circulating shift register of 8 stages (1 stage = 6 bits) including a gate circuit provided at the input side thereof. The key code memory 6 can memorize a key code in each of eight channels corresponding to the maximum number of tones to be reproduced simultaneously and sequentially shift and delivers out the stored key codes as well as circulate them inside the memory in response to the clock $\phi$. When a new claim signal NCL used for causing the key code memory 6 to store a new key code has been applied to the gate circuit, the key code memory 6 memorizes the new key code. Accordingly, the contents of the channel corresponding to the new key code are rewritten.

A comparison circuit 7 compares the key codes KC from the key code generator (encoder) 5 with the key codes stored in the memory 6 by each channel period and, when they coincide with each other, produces a coincidence signal CMP in a channel period corresponding to the channel in which the coincidence has occurred. A depressed key memory 8 stores information as to whether a key has been depressed with respect to each of the channels equal in number to the maximum number of tones to be reproduced simultaneously and produces the claim signal CLM in a channel corresponding to a depressed key. The depressed key memory 8 consists of an eight stage circulating shift register having a gate circuit on the input side thereof.

Contents of each stage thereof are sequentially shifted by the clock $\phi$ and the claim signal CLM is produced in a channel period corresponding to the channel of the depressed key.

A memory control unit 9 is provided for controlling operations of the key code memory 6 and the depressed key memory 8. The memory control unit 9 produces a new claim signal NCL upon detection of depression of a new key and a release signal RLS upon detection of release of a depressed key. The new claim signal NCL is used for controlling the key code memory 6 to store a new key code KC and causing the claim signal CLM to be stored in the corresponding channel of the depressed key memory 8. The release signal RLS is used for resetting the claim signal CLM stored in the corresponding channel of the depressed key memory 8. Whether a particular signal provided from the memory control unit 9 represents depression of a new key or release of a depressed key is discriminated on the basis of the result of comparison in the comparison circuit 7. If the key code KC corresponding to the key switch in which the change has occurred has already been stored in the key code memory 6, the signal from the memory control unit 9 represents release of the key, whereas if the key code has not been stored in the memory 6 yet, the signal represents depression of the key.

More specifically, the memory control unit 9 produces the new claim signal NCL in a channel period corresponding to a single empty channel in which decay has progressed further than any other channels among empty channels in which depression of the corresponding key is not stored (i.e. the key has already been released and no claim signal CLM is being produced) under conditions that (1) the change occurrence pulse P has been produced and (2) the coincidence signal CMP has not been produced. The memory control unit 9 also produces the release signal RLS in a channel period corresponding to a channel in which the coincidence signal CMP has been produced under conditions that (1) the change occurrence pulse P has been produced and (2) the coincidence signal CMP has been produced. Comparison of the key codes of all of the 8 channels in the comparison circuit 7 requires 8 channel periods. Further, detection of the above described conditions is made during occurrence of the comparison region pulse Rc.

Then the new claim signal NCL or the release signal RLS is produced during occurrence of the load region pulse RL in a channel period corresponding to the channel in which the change of the state of key switch has occurred. The gate circuits of the key code memory 6 and the depressed key memory 8 are controlled by these signals NCL and RLS to rewrite the contents of the memories.

The key codes stored in the key code memory 6 are supplied in time-shared sequence to a decoder 10 in response to the clock $\phi$. The decoder is with 6 bit inputs and 61 individual outputs. The decoder 10 in turn produces a signal on a single output line corresponding to the input key code among 61 output lines thereof corresponding to the respective key switches. This signal represents that the key corresponding to this key switch is being depressed and hereinafter called a key signal KY. The key signal KY is applied to a claimed key signal generator 11 and is also utilized for generation of musical tones.

The claimed key signal generator 11 receives the claim signals CLM of the respective channels provided from the depressed key memory 8. The claimed key signal generator 11 detects a key switch which corresponds to the key signal KY and for which the claim signal is being produced in the channel period during which this key signal KY is present, and thereupon provides the claimed key signal CLK on its output line corresponding to this key switch. It will be noted that each claim signal CLM produced in time-shared sequence from the depressed key memory 8 merely represents that a key has been depressed in a particular channel. The claimed key signal generator 11 therefore detects which key switch relates to the ON information stored in the particular channel and produces the claimed key switch signal CLK which is a result of the detection after temporarily holding it during the presence of the pulse RL. Accordingly, detection with respect to all of the channels is completed in the last channel period during the pulse RL. At this time, the claimed key switch signal CLK is produced on a plurality of output lines corresponding to key switches on which the ON information is present among the 61 output lines of the claimed key signal generator 11. A maximum number of output lines on which the claimed key signal CLK is produced is eight in which case the ON information is present in all the channels.

During the last channel period of the pulse RL, the system synchronizing clock $\phi_{16}$ is produced and the change detection signal CHG* is stored in the buffer memory 3 again. In the above described manner, a series of control operation is completed in one period of the system synchronizing clock $\phi_{16}$. The rewritten contents of the memories 6 and 8 are applied without being delayed to the claimed key signal generator 11 in a predetermined channel period. The contents of the memories 6 and 8 and the claimed key signal generator 11 are rewritten during presence of the store region pulse RL.

An old signal generator 12 is provided for detecting a channel in which decay has progressed furthest of all channels in which the keys have been released. The old signal generator 12 substantially counts lapse of time after the release of the key in each channel, compares results of counting and produces an old signal OL in a channel period corresponding to the channel in which the key was released before any other channels. More specifically, lapse of time is actually counted by each channel or, alternatively, the number of keys released after release of a key in a particular channel is counted for this particular channel and such counting is effected for each of channels in which the keys have been released. In either case, results of counting for the respective channels are compared and the old signal OL is produced in a channel period corresponding to a channel in which the count is the greatest. For example, under condition that an inverted claim signal $\overline{CLM}$, is produced (i.e. the key has been released) in a particular channel, the number of the change occurrence pulse p at the time of presence of the coincidence signal CMP is counted separately for each of channels in which the inverted claim signal $\overline{CLM}$ is produced (i.e. the number of newly released keys is counted). Since, however, the change occurrence pulse P is produced during 16 channel periods, one round of counting is carried out for each of the channels in which the keys have been released only during 8 channel periods during which the comparison region pulse Rc is produced. Thus, cumulative counting is made for each of the channels each time a key has been released. When the new claim signal NCL has been produced in a certain channel period, the counted value for the channel is reset.

Outputs of the decoder 10 is used, for instance, as key gate control signals $N_1 - N_{61}$ corresponding to the respective key switches. The key assigner according to the invention may be utilized for producing a plurality of tones simultaneously in an electronic musical instrument called music synthesizer as described later with reference to FIG. 7. This type of electronic musical instrument is constructed in such a manner that note voltages are sampled in time-shared sequence by gate-controlling key gate circuits corresponding to respective keys, the sampled note voltages are separately held, and a plurality of musical tones are reproduced on the basis of these separately held note voltages. The above described key gate control signal $N_1 - N_{61}$ are applied to gate inputs of the key gate circuits and the note voltages are sampled in time-shared sequence at a sampling rate corresponding to the clock $\phi$. In sampling analog note voltages, sufficient time is required in accordance with response characteristics of an analog circuit. According to the inventive key assigner, the clock $\phi$ is produced at a relatively low rate, so that no particular means are required for converting the time-sharing rate but the outputs of the decoder 10 can be directly applied to the respective key gates.

In the above described type of electronic musical instrument, reproduction of musical tones on the basis of the note voltages is controlled in accordance with an envelope waveshape which is separately produced. This envelope waveshape is formed in accordance with envelope control signals $EG_1 - EG_8$ for the respective channels which are produced by an envelope control signal generator 13. The envelope control signal generator 13 is constructed of a latch circuit and separately latches the claim signals CLM of the respective channels produced in time-sharing from the depressed key memory 8 by first through eight channel synchronizing clocks $\phi_{c1} - \phi_{c8}$ respectively synchronizing with the channel periods of the respective channels. The generator 13 thereafter separately produces the envelope control signals $EG_1 - EG_8$ each indicating whether the key has been depressed in the respective channels.

The key assigner according to the invention may be utilized not only for the above described electronic musical instrument but in other types of electronic musical instruments in which musical tones are digitally formed in accordance with key codes sequentially sent from a key code memory.

A specific construction of a main part of the key assigner according to the invention will be described hereinbelow.

Figure 3:
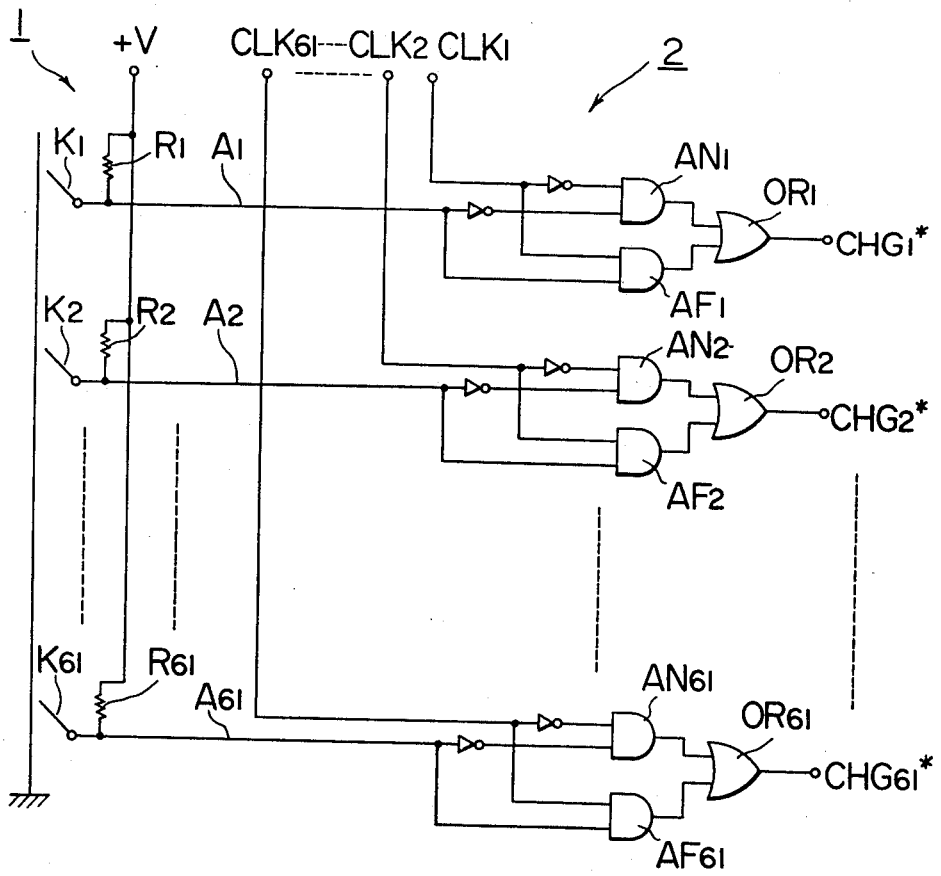
FIG. 3 is a circuit diagram showing in detail the keyboard circuit and the change detection circuit shown in FIG. 2.

FIG. 3 is a block diagram showing example of the keyboard circuit 1 and the change detection circuit 2. Positive voltage +V is applied to key switches $K_1 - K_{61}$ through pull-up resistors $R_1 - R_{61}$. When one of the key switches $K_1 - K_{61}$ is turned ON (i.e. the key has been depressed), a signal "0" is provided on corresponding one of output lines $A_1 - A_{61}$. When the key switch is turned OFF (i.e. the key has been released), a signal "1" is provided on the corresponding output line.

The claimed key signal $CLK_1 - CLK_{61}$ respectively corresponding to the key switches $K_1 - K_{61}$ are "1" if depression of the key has already been stored, and "1" if depression of the key has already been stored, and "0" if depression of the key has not been stored. Inverted signals of the ON-OFF detection signals provided on the output lines $A_1 - A_{61}$ and inverted signals of the claimed key signals $CLK_1 - CLK_{61}$ are respectively supplied to corresponding AND circuits $AN_1 - AN_{61}$ which detect change occurring when a new key has been depressed (signal "1"). On the other hand, the ON-OFF detection signals and the claimed key signals are directly applied to AND circuits $AF_1 - AF_{61}$ which detect change occurring when the depressed key has been released (signal 1). The outputs of the AND circuits $AN_1 - AN_{61}$ and $AF_1 - AF_{61}$ are applied to corresponding OR circuits $OR_1 - OR_{61}$. Outputs of the OR circuits $OR_1 - OR_{61}$ constitute change detection signals $CHG_1^* - CHG_{61}^*$. The change detection signal CHG* is "1" when it represents a key switch in which change has occurred and "0" when it represents a key switch in which no change has occurred.

These change detection signals $CHG_1^* - CHG_{61}^*$ are memorized in the buffer memory 3 in response to the system synchronizing clock 16 and held therein as change detection signals $CHG_1 - CHG_{61}$ for 16 channel periods.

Figure 4:
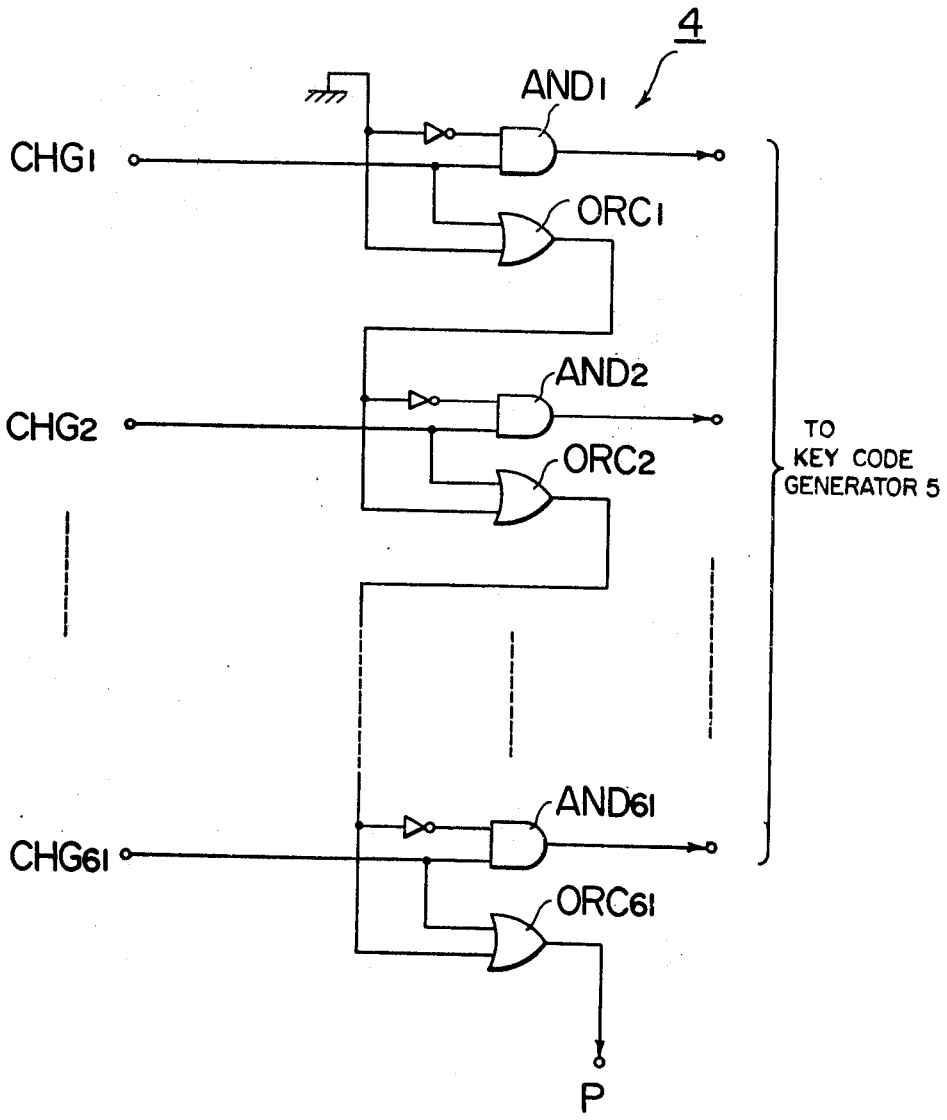
FIG. 4 is a circuit diagram showing in detail the priority circuit shown in FIG. 2.

FIG. 4 is a block diagram showing an example of the priority circuit 4. The order of priority is the key switches $K_1, K_2, \ldots K_{61}$. The change detection signals $CHG_1 - CHG_{61}$ are applied to AND circuits $AND_1 - AND_{61}$ and also to OR circuits $ORC_1 - ORC_{61}$. The outputs of the OR circuits $ORC_1 - ORC_{60}$ are applied through inverters to the AND circuits $AND_2 - AND_{61}$ which are of a lower priority order and also to the OR circuits $ORC_2 - ORC_{61}$ of a lower priority order. Each of the outputs of the AND circuits $AND_1 - AND_{61}$ is applied to the key code generator (encoder) 5 as the output of the priority circuit 4. It should be noted that if a plurality of change detection signals CHG are "1", only a signal of the top priority is selected and a selected single AND circuit among the AND circuit $AND_1 - AND_{61}$ produces an output signal "1". The AND circuit $AND_1$ which ranks first in the priority order constantly receives an inverted output of a zero level signal (i.e. signal "1"). The OR circuit $ORC_1$ constantly receives a signal "0".

If, for example, the signals $CHG_2$ and $CHG_{61}$ only are "1", the output of the OR circuit $ORC_1$ is "0" and the AND circuit $AND_2$ produces an output "1". The output of the OR circuit $ORC_2$ is "1" so that the AND circuit $AND_3$ (not shown) of a lower priority order is disenabled through an inverter and the OR circuit $ORC_3$ (not shown) of a lower priority order produces an output "1". Subsequent OR circuits produce a signal "1" in like manner and this signal "1" acts as an inhibit signal causing the subsequent AND circuits to be disenabled one after another. Accordingly, the AND circuit $AND_{61}$ produces an output "0". In the foregoing manner, the output line associated with the key switch $K_2$ only is selected to produce a signal SL (signal "1") thereon. The output signal "1" of the OR circuit $ORC_{61}$ of the lowest priority order is provided as the change occurrence pulse p.

Thus, a key code corresponding to the single key switch selected by the priority circuit 4 is encoded by the key code generator 5 and provided therefrom. In the comparison circuit 7 and the memory control unit 9, comparison and detection of the above described conditions are carried out for 8 channel periods during which the comparison region pulse Rc is present.

Figure 5:
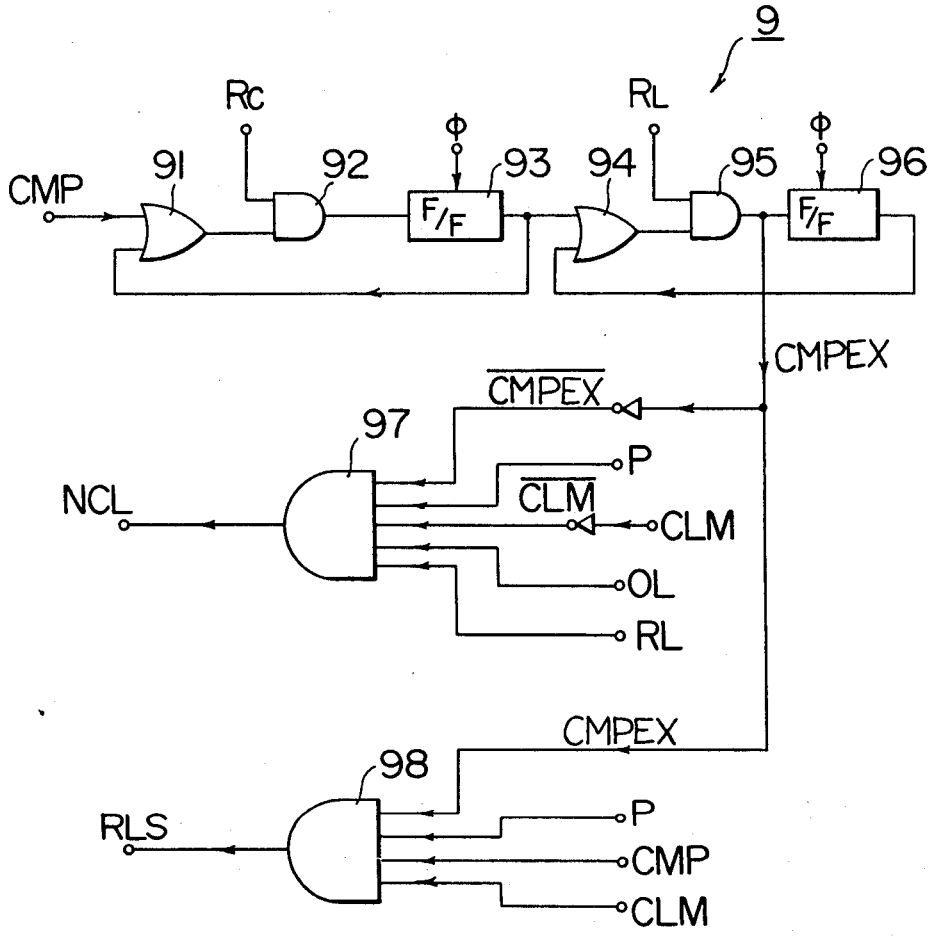
FIG. 5 is a circuit diagram showing in detail the memory control unit shown in FIG. 2.

FIG. 5 is a block diagram showing an example of the memory control unit 9. The coincidence signal CMP which is produced from the comparison circuit 7 every channel period is applied to a flip-flop 93 through an OR circuit 91 and an AND circuit 92. The coincidence signal CMP is "1" if there is coincidence and "0" if there is no coincidence. The output of the flip-flop 93 is circulated through the OR circuit 91. The AND circuit 92 receives also the comparison region pulse Rc. If, accordingly, there is at least one channel among the eight channels in which the coincidence signal is "1", the flip-flop 93 stores a signal "1" in the last channel period of the comparison region pulse Rc.

An OR circuit 94, an AND circuit 95 and a flip-flop 96 are provided for holding the output signal of the flip-flop 93 during occurrence of the load region pulse RL. A coincidence hold signal CMPEX is produced from the AND circuit 95. This coincidence hold signal CMPEX has a pulse width of 8 chnnel periods and is used for holding, during the pulse period of the load region pulse RL, the coincidence signal CMP detected in the pulse period of the comparison region pulse Rc.

An AND circuit 97 receives an inverted signal CMPEX of the coincidence hold signal CMPEX, the change occurrence pulse P, the load region pulse RL, an inverted signal CLM of the claim signal CLM and the old signal OL produced in a channel period corresponding to the channel in which decay has progressed further than any other channels. The new claim signal NCL is produced in a channel period during which conditions of all these input signals are satisfied. On the other hand, an AND circuit 98 receives the coincidence hold circuit CMPEX, the change occurrence pulse P, the coincidence signal CMP and the claim signal CLM and produces the release signal RLS in a channel period during which conditions of all these input signals are satisfied.

In 8 channel periods during which the load region pulse RL is present, the contents of the key code memory 6 and the depressed key memory 8 are rewritten and the claimed key signal CLK is generated in the claimed key switch signal generator 11 in response to the new claim signal NCL or the release signal RLS produced in the above described manner.

Figure 6:
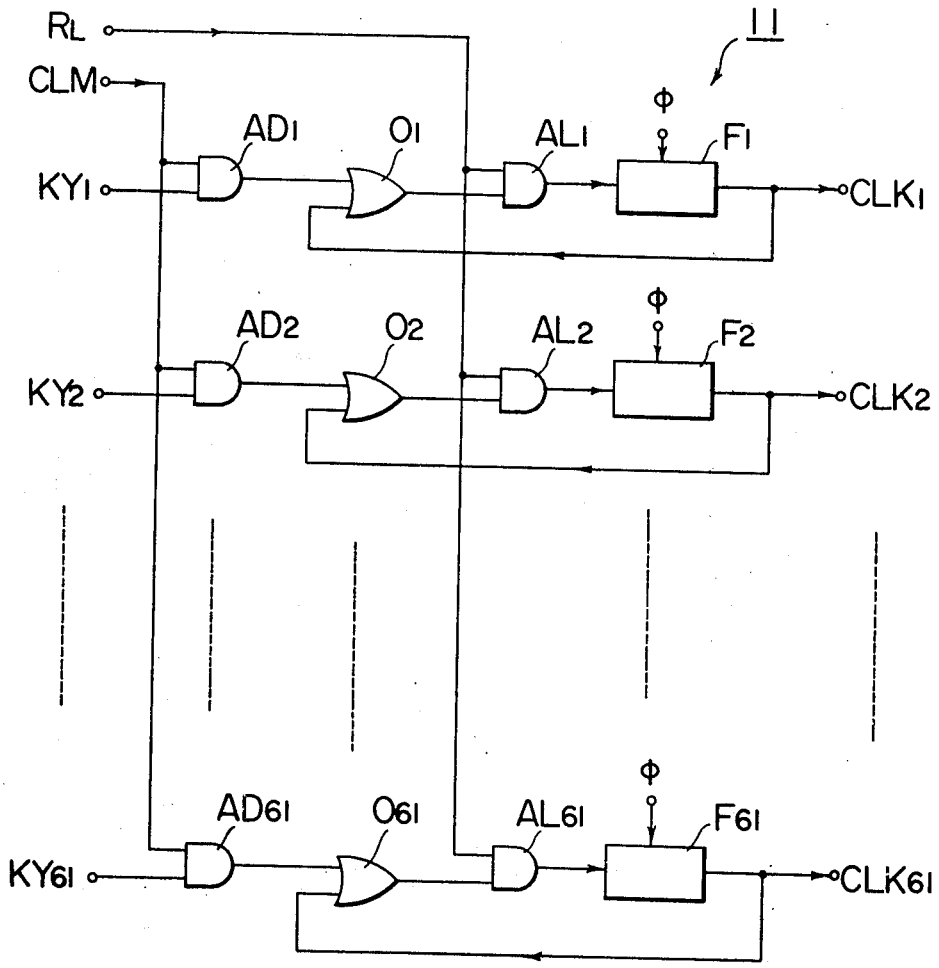
FIG. 6 is a circuit diagram showing in detail the claimed-key signal generator shown in FIG. 2.

FIG. 6 is a block diagram showing an example of the claimed key switch signal generator 11. AND circuits $AD_1 - AD_{61}$ receive, at one input terminal thereof, corresponding key signals $KY_1 - KY_{61}$ provided from the decoder 10 (FIG. 2) and, at the other input terminal thereof, the claim signal CLM supplied in time-sharing on a common output line of the depressed key memory 8. Accordingly, only one of the AND circuits $AD_1 - AD_{61}$ produces an output signal "1" in a particular channel period. This signal "1" is supplied through corresponding one of OR circuits $O_1 - O_{61}$ and AND circuits $AL_1 - AL_{61}$ to one of flip-flops $F_1 - F_{61}$ associated with the key switch and stored in this flip-flop. The AND circuits $AL_1 - AL_{61}$ receive also the common load region pulse RL thereby causing the flip-flop to hold the signal "1" only during occurrence of the load region pulse RL. The stored contents of the flip-flop $F_1 - F_{61}$ are read out in response to the clock $\phi$ and held therein during occurrence of the load region pulse RL by circulating through associated ones of the OR circuits $O_1 - O_{61}$ and the AND circuits $Al_1 - Al_{61}$. Since the claim signal CLM is provided in time-shared sequence, detection as to which key switch is associated with the ON information represented by the claim signal CLM has been completed with respect to all of the eight channels in the last channel period of the pulse RL (i.e.

the eight channel) and results of detection have been stored in the flip-flops $F_1 - F_{61}$.

The outputs of the flip-flops $F_1 - F_{61}$ are supplied in parallel to the change detection circuit 2 as the claimed key signals $CLK_1 - CLK_{61}$. Since the maximum number of tones to be reproduced simultaneously is eight in the present embodiment, the number of claimed key signal ($CLK_1 - CLK_{61}$) which are "1" is at most eight. The claimed key switch signals CLK can be changed every time the load region pulse RL is produced (if the change detection circuit 2 has detected change). In other words, contents of the claimed key signals $CLK_1 - CLK_{61}$ concerning the key switches selected by the priority circuit 4 are rewritten. If, for example, contents of the claimed key switch signal $CLK_1$ corresponding to the key switch $K_1$ are rewritten, the change in the key switch $K_1$ is not detected in a next period but another key switch in which change has been detected is selected by the priority circuit 4.

In the foregoing manner, information about a key on which change has been detected due to depression of a new key or release of a depressed key is processed by each key at a period of the system synchronizing clock $\phi_{16}$ and in a predetermined order of priority.

Figure 7:
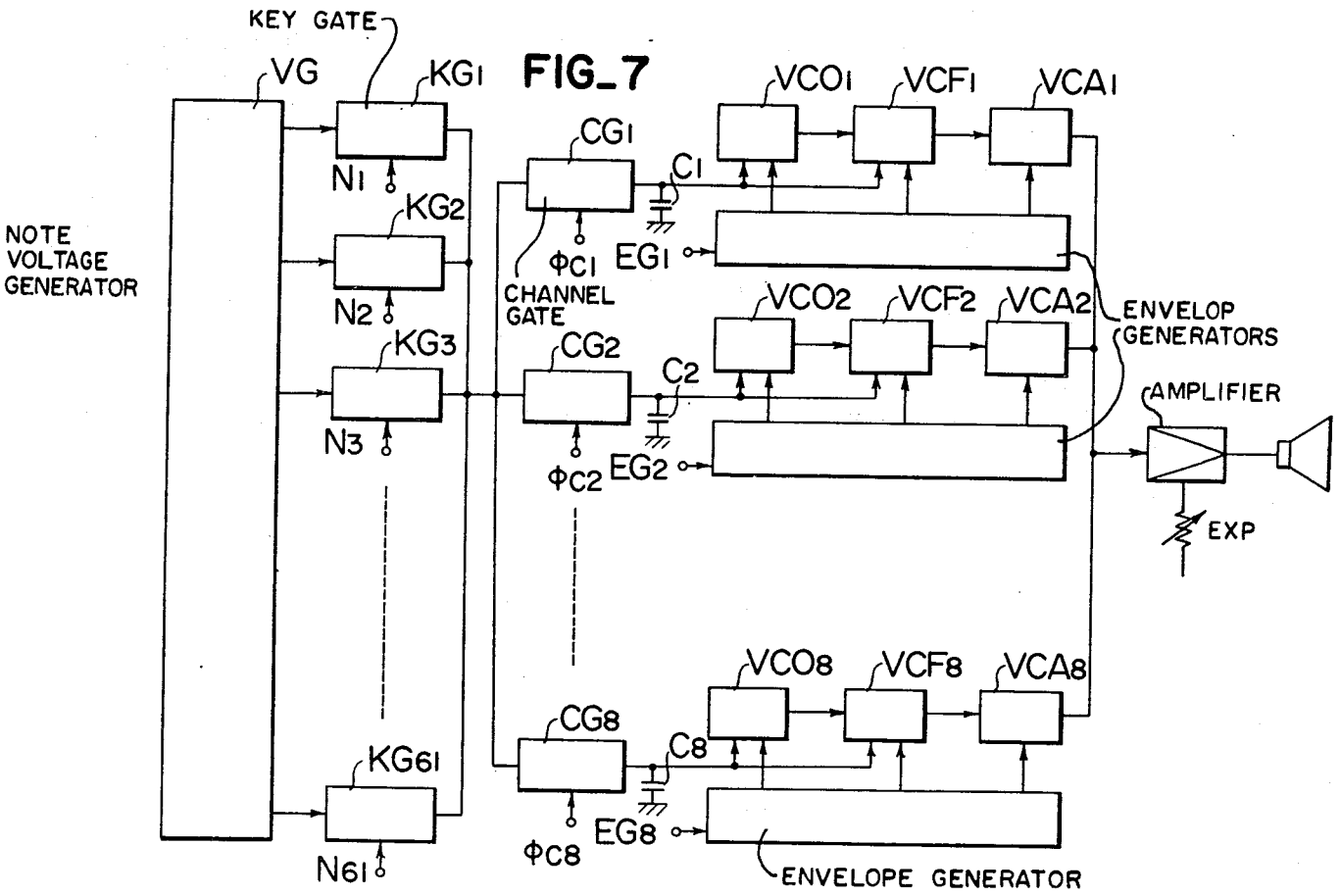
FIG. 7 is a block diagram of an example of a polyphonic music synthesizer to be incorporated with the key assigner of the present invention.

The electronic musical instrument shown in FIG. 7 is provided with 61 keys and comprises a voltage generating circuit VG for generating note voltages $V_1$ through $V_{48}$ corresponding to respective keys, not shown, and a plurality of key gate circuits $KG_1$ through $KG_{61}$ which are enabled when they are supplied with corresponding key gate control signals $N_1$ through $N_{61}$, respectively, for passing or sampling the note voltages $V_1$ through $V_{61}$ respectively. Key gate control signals $N_1$ through $N_{61}$ are applied to respective key gate circuits one at a time as will be described later. The outputs of the key gate circuits $KG_1$ through $KG_{61}$ are applied to channel gate circuits $CG_1$ through $CG_8$ corresponding to respective channels which are equal in number to the maximum number of tones to be reproduced simultaneously, (8 in the present example). These channel gates function to further sample the sampled note voltages. More particularly, the channel gate circuits $CG_1$ through $CG_8$ which receive channel gate signals $\phi_{c1}$ through $\phi_{c8}$ are enabled for charging corresponding ones of a plurality of capacitors $C_1$ through $C_8$. As will be described later, these channel gate signals $\phi_{c1}$ through $\phi_{c8}$ are applied in synchronism with the key gate control signals. The note voltages charged in and held by capacitors $C_1$ through $C_8$ of respective channels are applied to voltage-controlled oscillators $VCO_1$ through $VCO_8$ respectively thereby causing these oscillators to generate signals respectively having frequencies determined by respective note voltages. The output signals from oscillators $VCO_1$ through $VCO_8$ are passed successively through voltage-controlled filters $VCF_1$ through $VCF_8$ and voltage-controlled amplifiers $VCA_1$ through $VCA_8$, respectively so that the output signals are suitably filtered and amplified to be produced as tones through an acoustic device including an amplifier AMPL with an expression control EXP and a loudspeaker SP. Further, there are provided eitht envelope generators $EN_1$ through $EN_8$ which are constructed to generate predetermined envelope signals when they are supplied with envelope gate control signals $EG_1$ through $EG_8$. As a consequence, the voltage-controlled filters $VCF_1$ through $VCF_8$ operate to control the tone color in accordance with the envelope signals whereas the voltage-controlled amplifiers $VCA_1$ through $VCA_8$ function to control the volume of the tone in accordance with the envelope signals.

Figure 8:
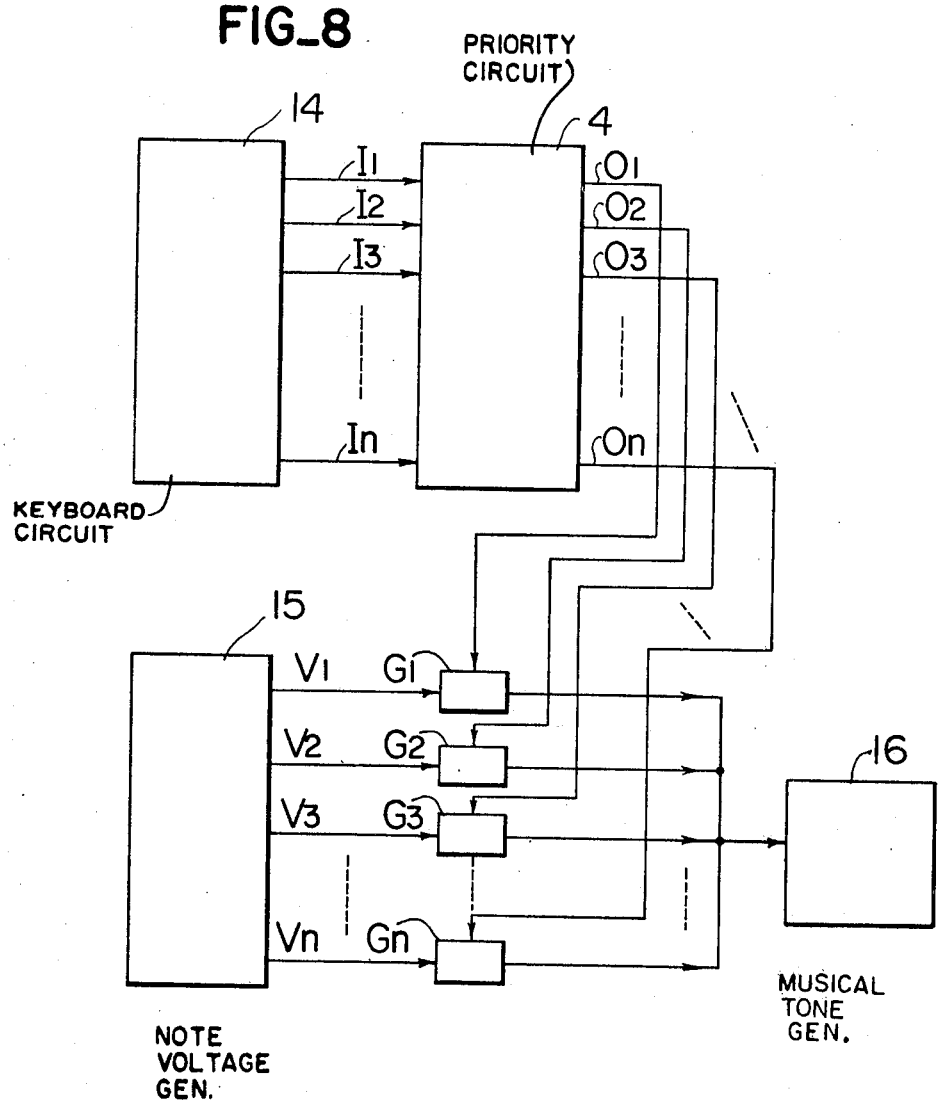
FIG. 8 is a block diagram showing an embodiment of the priority circuit according to the invention used in monophonic music synthesizer.

FIG. 8 shows an example of the key assigner according to the invention used in a single tone music synthesizer. Since a musical tone generator 16 including a voltage-controlled oscillator, a voltage-controlled filter and a voltage-controlled amplifier can generate only a single tone at a time, a priority circuit 4 which is of a construction similar to the tone shown in FIG. 4 is employed to select a single key from among a plurality of keys if these keys are simultaneously depressed. This priority circuit 4 which is of a digital type can be separately provided from a note voltage generation circuit 15. A keyboard circuit 14 consists of a key switch circuit including key switches driven by the respective keys and merely producing digital signals of "1" and "0" to the ON-OFF states of the key switches. Accordingly, it will be understood that the construction of the keyboard circuit 14 has been remarkably simplified owing to the employment of the inventive key assigner in the music synthesizer.

The key switches respectively correspond to input lines $I_1 - I_n$ of the priority circuit 4. When a key switch in the keyboard circuit is turned ON, an input signal is provided on corresponding one of the input lines $I_1 - I_n$. In the priority circuit 4, a signal for a single key switch is selected in accordance with a predetermined priority order and a signal "1" is produced on only one output line among output lines $O_1$–$O_n$. The output lines $O_1$–$O_n$ are connected to gate control input terminals of gate circuits $G_1$–$G_n$ consisting of electronic switches such, for example, as field-effect transistors. A single note voltage among note voltages $V_1$–$V_n$ generated in the note voltage generation circuit 15 corresponding to the selected key switch is gated through the gate circuit which has received the signal representing the selected key switch to the musical tone generator 16. The note voltages $V_1$–$V_n$ corresponding to the respective notes are constantly generated in the note voltage generation circuit 15.

What is claimed is:

1. A key assigner comprising:

key state memory means for storing signals representing previous states of depression and release of respective keys by each key;

a keyboard circuit for simultaneously and parallelly delivering signals corresponding to the ON-OFF states of key switches interlocked with the respective keys;

change detection means comprising a logical circuit for comparing by each key the signals provided from said key state memory means with the signals provided from said keyboard circuit and detecting change from the previous state of the key switches to the present state thereof at a predetermined time interval;

a priority circuit for selectively delivering out a single signal from among change detection signals supplied from said change detection means in accordance with a predetermined priority order at said predetermined time interval;

a key code generator for generating key codes corresponding to the change detection signals provided from said priority circuit;

a key code memory having channels equal in number to a maximum number of tones to be reproduced simultaneously and being capable of storing the key codes in the respective channels;

key state detection means for detecting whether the key code supplied from said key code generator corresponds to a newly depressed key or a released key;

key code loading means for loading the key code from said key code generator in a corresponding channel of said keycode memory if the key code corresponds to a newly depressed key;

a decoder for decoding the key codes provided from said key code memory; and control means for causing said key state memory means to store signals representing states of depression and release of the respective keys in accordance with the decoded signals provided from said decoder;

tone generation control signals being produced on output lines of said decoder corresponding to the respective keys.

2. A key assigner as defined in claim 1 wherein said priority circuit comprises:

a plurality of input lines arranged in a predetermined priority order;

inhibit signal generation circuits respectively provided in correspondence to said input lines and producing, in the presence of the change detection signal on any one of said input lines, an inhibit signal to the input lines which are of a lower priority order relative to said input line on which the change detection signal is present; and selection circuits respectively provided in correspondence to said input lines and gating out the applied change detection signal under non-application of the inhibit signal.

3. A key assigner as defined in claim 1 wherein said key state detection means comprise a circuit for comparing the key codes provided from said key code generator with key codes of all of the channels already stored in said key code memory, non-coincidence of the two key codes representing depression of the key and coincidence thereof representing release of the depressed key.

4. A key assigner as defined in claim 1 wherein said key code loading means comprise:

a depressed key memory for constantly storing states of the depressed keys by each channel and circulatingly producing them;

clearing means for clearing information of the depressed key in the corresponding channel of said depressed key memory upon detection of release of the depressed key;

an old signal generator connected to the output terminal of said depressed key memory and producing an old signal representing a channel in which the key has been released first among channels in which depression of the key is not stored; and means for applying, when a new key has been depressed, a load control signal to said key code memory in a channel period corresponding to said old signal.

5. A key assigner as defined in claim 4 wherein said control means comprise a logical circuit which causes the output of said decoder to be applied to said key state memory means only when the logical circuit has received a claim signal representing the channel of the depressed key from said depressed key memory.

* * * * *